US007439965B2

(12) United States Patent
Anderson

(10) Patent No.: US 7,439,965 B2
(45) Date of Patent: Oct. 21, 2008

(54) METHOD FOR DRIVING DISPLAY DEVICE

(76) Inventor: Daryl E. Anderson, 3299 SE. White Oak Rd., Corvallis, OR (US) 97333

( * ) Notice: Subject to any disclaimer, the term of this patent is extended or adjusted under 35 U.S.C. 154(b) by 776 days.

(21) Appl. No.: 10/794,621

(22) Filed: Mar. 5, 2004

(65) Prior Publication Data

US 2005/0195175 A1 Sep. 8, 2005

(51) Int. Cl.
*G09G 5/00* (2006.01)

(52) U.S. Cl. ..... 345/204; 345/1.1; 345/211; 345/698; 345/699

(58) Field of Classification Search ..... 345/1.1–3.4, 345/204–215, 690–699
See application file for complete search history.

(56) References Cited

U.S. PATENT DOCUMENTS

| | | | | |
|---|---|---|---|---|
| 5,122,783 | A | 6/1992 | Bassetti, Jr. | |
| 5,159,478 | A | 10/1992 | Akiyama et al. | |
| 5,552,800 | A | 9/1996 | Uchikoga et al. | |
| 5,598,565 | A | 1/1997 | Reinhardt | |
| 5,691,745 | A | 11/1997 | Mital | |
| 5,712,651 | A | 1/1998 | Tomiyasu | |
| 5,790,215 | A | 8/1998 | Sugahara et al. | |
| 5,854,627 | A | 12/1998 | Kurihara et al. | |
| 5,940,049 | A | 8/1999 | Hinman et al. | |
| 6,072,454 | A | 6/2000 | Nakai et al. | |
| 6,175,355 | B1 | 1/2001 | Reddy | |
| 6,184,853 | B1 | 2/2001 | Hebiguchi et al. | |
| 6,198,469 | B1 | 3/2001 | Tjandrasuwita | |
| 6,222,508 | B1 | 4/2001 | Alvelda et al. | |
| 6,232,938 | B1 | 5/2001 | Tsuchida et al. | |
| 6,326,942 | B1 | 12/2001 | Akimoto | |
| 6,542,141 | B1 | 4/2003 | Mano et al. | |
| 6,556,181 | B2 | 4/2003 | Yamada et al. | |
| 6,825,835 | B2 * | 11/2004 | Sano et al. | 345/204 |
| 7,245,272 | B2 * | 7/2007 | Shiuan et al. | 345/2.2 |
| 2002/0063701 | A1 * | 5/2002 | Sano et al. | 345/204 |
| 2004/0075622 | A1 * | 4/2004 | Shiuan et al. | 345/1.1 |

FOREIGN PATENT DOCUMENTS

| | | |
|---|---|---|
| JP | 2001147671 | 5/2001 |
| JP | 2003108094 | 9/2001 |

* cited by examiner

*Primary Examiner*—Vijay Shankar

(57) ABSTRACT

A method is provided for reducing power consumption in a digital display including an array of pixels. The method includes reducing a switching frequency for driving the array of pixels and dividing the array of pixels into groups of a predefined size. A representative value of the input data for the group of pixels may be obtained using a weighting function and the group of pixels are driven to display the representative value.

16 Claims, 7 Drawing Sheets

METHOD FOR DRIVING DISPLAY DEVICE

BACKGROUND

Displays can be one of the main consumers of power in electronic devices. Reflective capacitive displays are generally more efficient than emissive displays as they only have to charge a capacitive plate rather than generate a continuous emission via a current. However, the more frequently that such capacitive plates are charged, the more power the display uses, both in the display and the drive electronics. Color displays in particular can have very high switching speeds, leading to significant power drain which can be undesirable under certain conditions such as during mobile (battery powered) operation. Prior solutions to this problem have included providing a larger battery for longer operation, but this increases the size and weight of the device.

SUMMARY

According to one exemplary embodiment, a method of driving a display includes reducing the refresh rate and driving blocks of pixels to display the results of a weighting function of an input image for the pixels in each group.

DETAILED DESCRIPTION OF EXAMPLE EMBODIMENTS

In the following detailed description of example embodiments, numerous specific details are set forth in order to provide a thorough understanding of the present invention. However, it will be appreciated by persons skilled in the art that the present invention may be practiced without these specific details. In other instances, well known methods, procedures, components and circuits have not been described in detail so as not to unnecessarily obscure aspects of the example embodiments. While the following detailed description of the example embodiments is provided in the context of color displays, it will be appreciated that the present invention is also applicable to monochrome displays.

Figure 1:
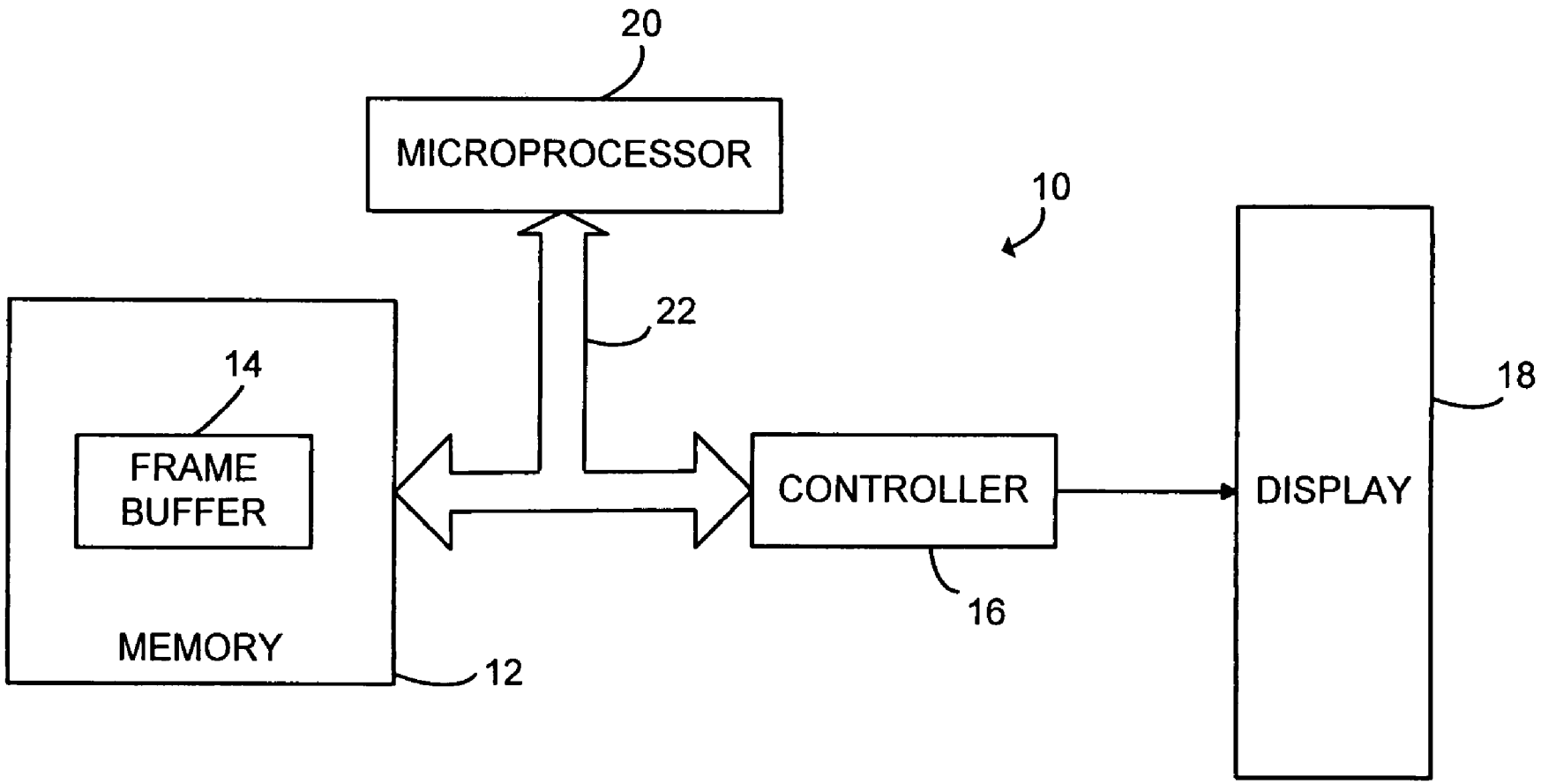
FIG. 1 shows an example of a display device that may be utilized in accordance with an embodiment of the present invention.

FIG. 1 illustrates an embodiment of a display device 10 to which the present invention may be applied. Display device 10 includes a memory 12, a frame buffer 14 formed in memory 12, a controller 16 and a display 18. Display 18 may be any type of display that includes an array of pixels. According to an exemplary embodiment, display 18 is a capacitively driven display of the reflective or transmissive type. Examples of such capacitively driven displays include liquid-crystal-display (LCD) devices, digital micro-mirror display (DMD) devices, and interferometric display devices (IDD). In the illustrated embodiment, display device 10 further includes a microprocessor 20 coupled to an address/data bus 22, which also interconnects memory 12 and controller 16.

Figure 2:
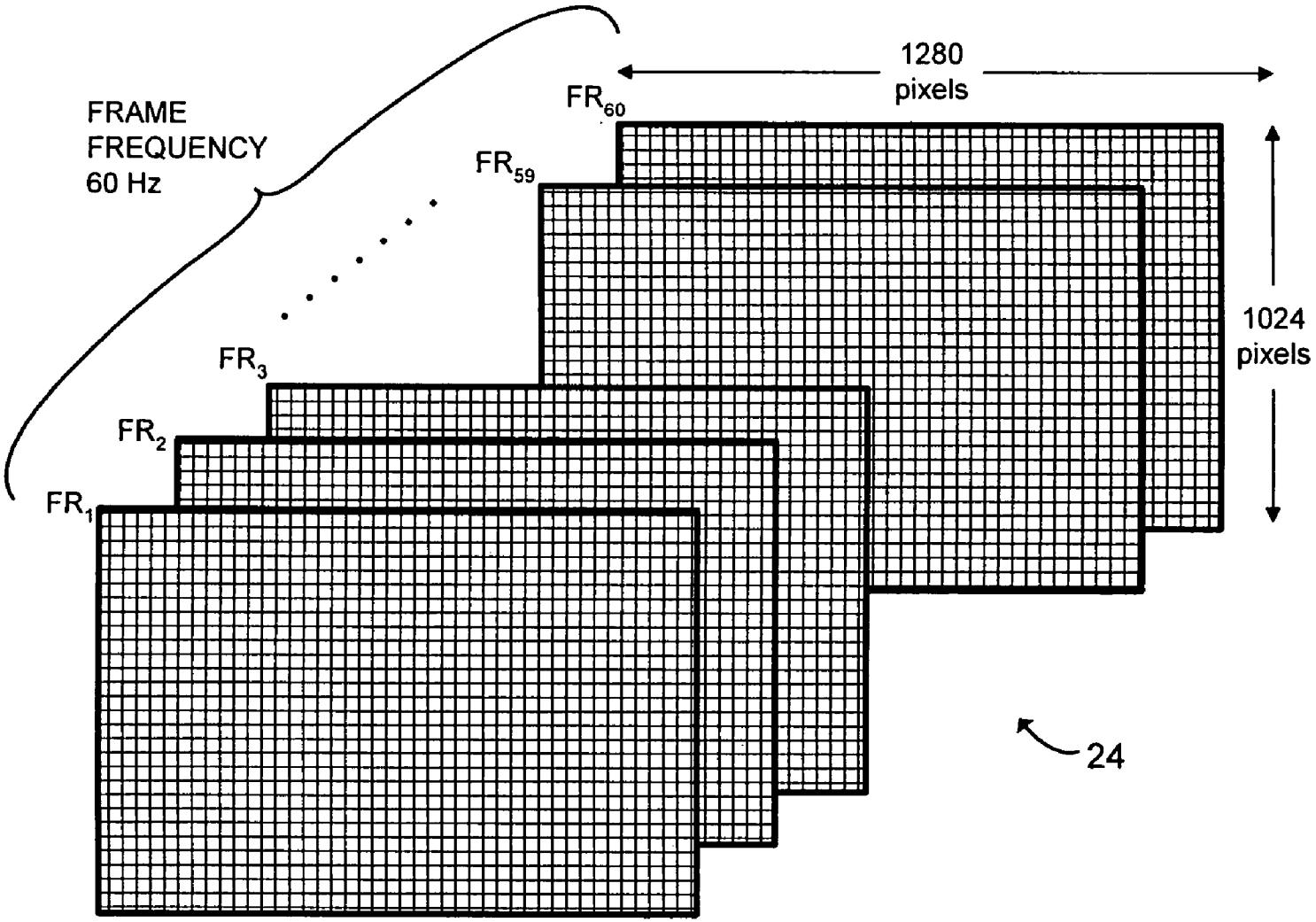
FIG. 2 shows an example of a frame frequency for driving an exemplary display device.

Referring now to FIG. 2, a display 24 comprises a large number of pixels that are arranged in rows and columns. In the illustrated embodiment, for example, display 24 is arranged into 1280 columns of pixels and 1024 rows of pixels (i.e., display 24 is illustrated with a 1280×1024 pixels display area). In other embodiments, display 24 may have other screen resolution sizes such as 640×480, 800×600, 1024×768, 1152×864, 1600×1200, and 2048×1536 pixel display area.

In addition to screen resolution size, display device 24 may be characterized by its refresh rate. This is the rate (or frequency) at which each full screen picture (or frame) stored in frame buffer 14 is displayed on display 24. The refresh rate is typically measured in hertz (cycles per second). In the embodiment illustrated in FIG. 2, for example, the frame frequency is 60 Hz. Accordingly, controller 16 repeatedly accesses frame buffer 14 and transmits 60 frames (numbered $FR_1$, $FR_2$, . . . $FR_{60}$) of image data to display 24 during each second of operation. If desired, display 24 may be configured using appropriate software and/or hardware to operate at some other frame frequency such as 30 Hz, 70 Hz, 85 Hz, 90 Hz, and so on.

Figure 3:
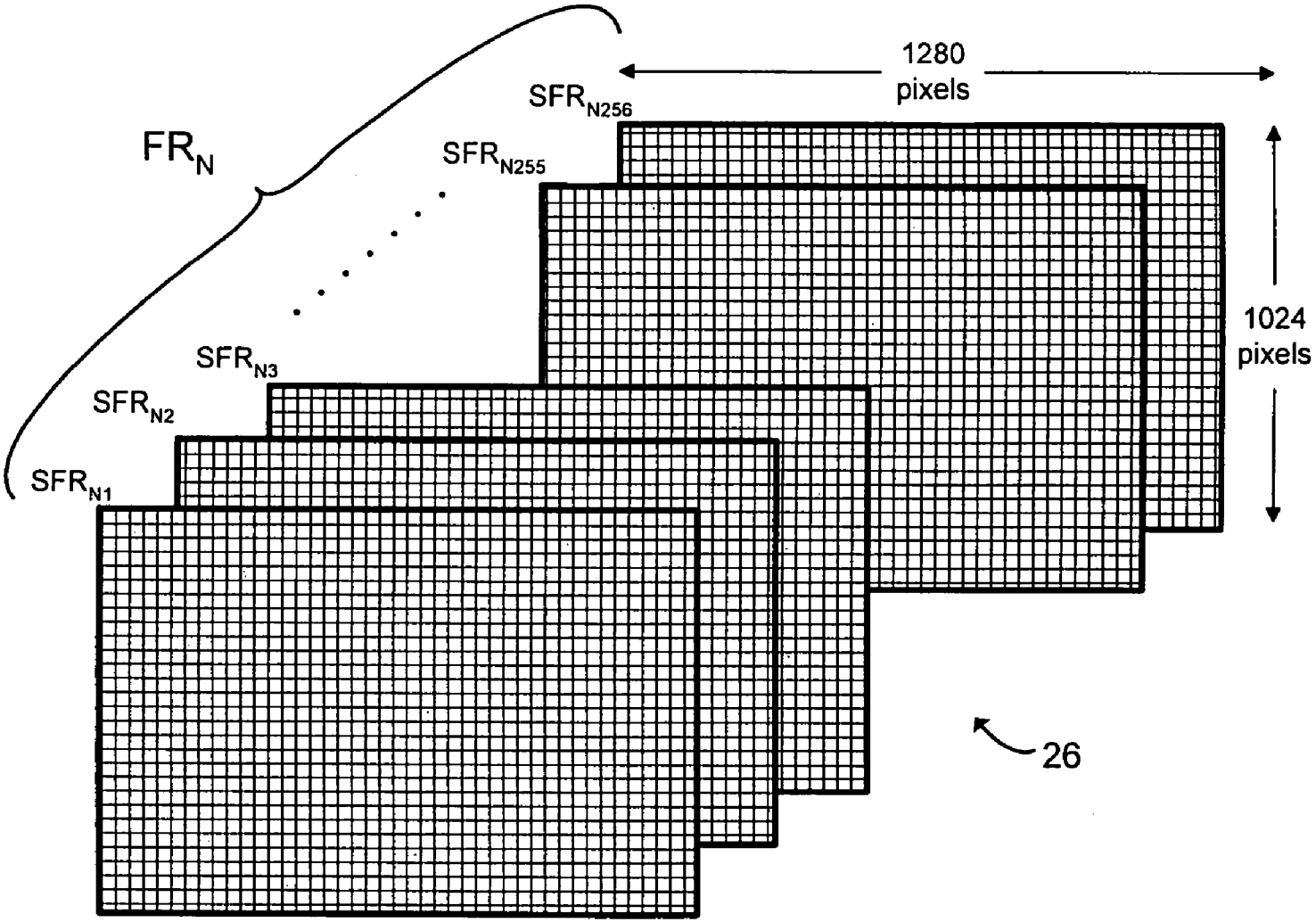
FIG. 3 shows an example of a relationship between the frame frequency and subframe frequency for driving a first type of display device.

Turning now to FIG. 3, an example of a relationship between a single frame ($FR_N$) and two or more subframes is illustrated in connection with a display 26 of a first type. In this example, each pixel of display 26 is capable of displaying one of eight possible colors at any given moment in time. These eight possible colors may be formed by combinations of the three additive primary colors: red (R), green (G), and blue (B). Alternatively, the eight possible colors may be formed from combinations of the three subtractive primary colors: cyan (C), magenta (M), and yellow (Y). In either case, each of the eight possible colors may be displayed in each pixel during each subframe. Table 1 below shows the eight possible color combinations that may be formed using the primary colors of red, green and blue:

| # | Red | Green | Blue |
|---|---|---|---|
| 1 | off | off | off |
| 2 | off | off | ON |
| 3 | off | ON | off |
| 4 | off | ON | ON |
| 5 | ON | off | off |
| 6 | ON | off | ON |
| 7 | ON | ON | off |
| 8 | ON | ON | ON |

In the example relationship illustrated in FIG. 3, each frame is formed from 256 subframes (numbered $SFR_{N1}$, $SFR_{N2}$, . . . $SFR_{N285}$). Assuming a sufficiently fast clock rate, the viewer's eye will integrate the individual color levels during the subframes to provide what appears to be a single composite color for the resulting frame. Hence, there are 256 ($=2^8$) possible levels of color for each primary color per frame in the illustrated embodiment. Thus, display 26 is capable of displaying 16,777,216 ($=256^3$) different colors in each frame. Since this is generally considered to be far more colors than the human eye is capable of distinguishing, display 26 may be considered to be operating in a "true color" mode. If desired, more or fewer than 256 subframes could be utilized to provide more or fewer than 256 possible color levels for each frame.

Figure 4:
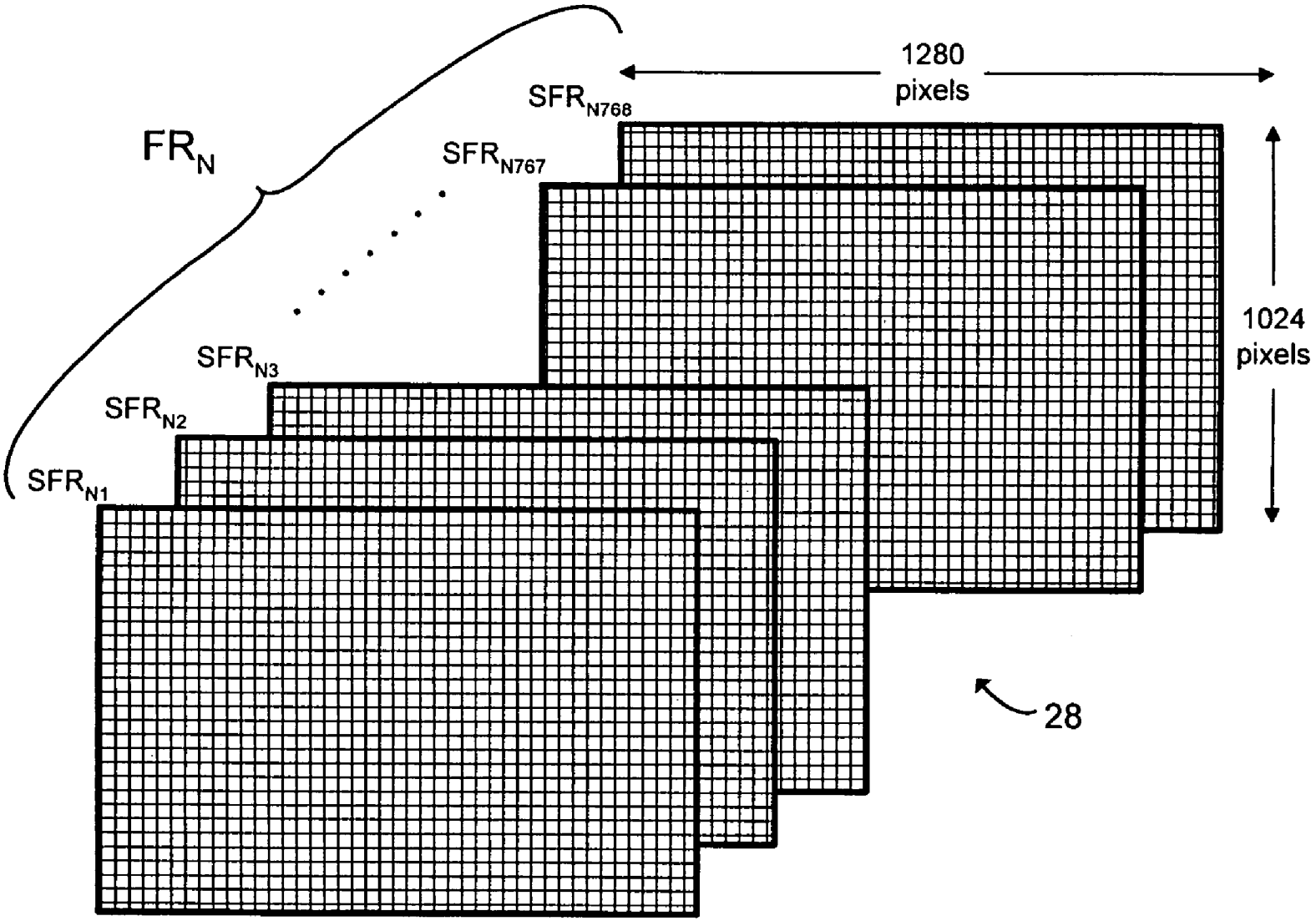
FIG. 4 shows another example of a relationship between the frame frequency and subframe frequency for driving a second type of display device.

Turning now to FIG. 4, an example of a display 28 of a second type is configured for true color operation. In this example, display 28 is capable of displaying only one primary color (e.g., one of red, green and blue) at any given moment in time. Thus, display 28 requires three times as many subframes per frame as display 26 to generate 256 levels of color for each primary per frame. In this example, each frame is formed from 768 subframes that alternate through the three primary colors. For example, subframe 1 ($SFR_{N1}$) may display the color red in selected pixels, subframe 2 ($SFR_{N2}$) may display the color green in selected pixels, and subframe 3 ($SFR_{N3}$) may display the color blue in selected pixels. This color sequence would then repeat. Since the 768 subframes ($SFR_{N1}$ through $SFR_{N768}$) used to form each frame ($FR_N$) in the embodiment of FIG. 4 are displayed in the same amount of time (i.e., $1/60^{th}$ of a second) as the 256 subframes ($SFR_{N1}$ through $SFR_{N256}$) used to form each frame ($FR_N$) in the embodiment of FIG. 3, display devices 26 and 28 are equivalent in terms of color depth (i.e., the maximum possible number of pixel colors per frame) when operating in true color mode.

When display devices are configured such as discussed above (e.g., true color operation), this higher switching frequency per frame can cause a significant power drain which can be undesirable during certain modes of operation such as mobile (battery) operation. In the embodiments of FIGS. 3 and 4, for example, each pixel is charged (and discharged) 256 and 768 times per frame, respectively. Additionally, much or most of the accompanying drive circuitry is switching at the same frequency. Each switching consumes power.

According to one embodiment, display 28 may be reconfigured (either manually or automatically as discussed below) in power constrained situations so that the amount of display and driver switching is reduced. One method for doing this is to simply not switch each pixel at 256 or 768 times per frame. For example, each pixel in the display of device 26 (FIG. 3) could be switched only once per frame (i.e., no subframes). Similar, each pixel in the display of device 28 (FIG. 4) could be switched only three times per frame (i.e., one subframe for each primary color). In either case, the power reduction would be a factor of 256 compared to true color (i.e., 24 bit color) operation mode. The reduced switching rate also allows for the use of slower rise times on the signals, which may reduce EMI (electromagnetic interference) and/or lower its frequency. However, an adverse effect of such limited switching would be a reduction of the color palette to only eight colors per frame (i.e., 3 bit color). Hence, reducing the frame frequency alone is not an ideal solution to power constrained situations.

Figure 5:
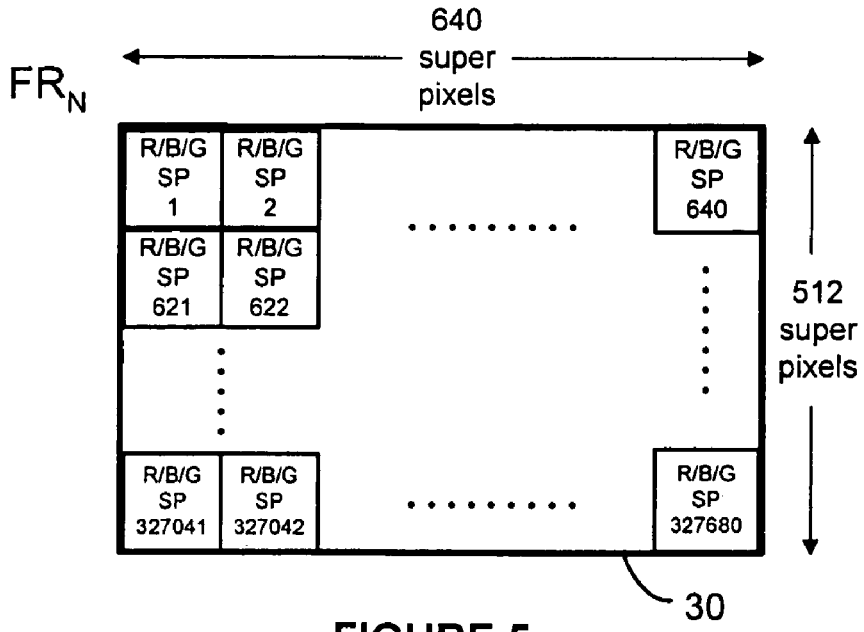
FIG. 5 shows an example of the subdivision of the display of FIG. 3 into groups of pixels in accordance with one embodiment of the present invention.
Figure 7:
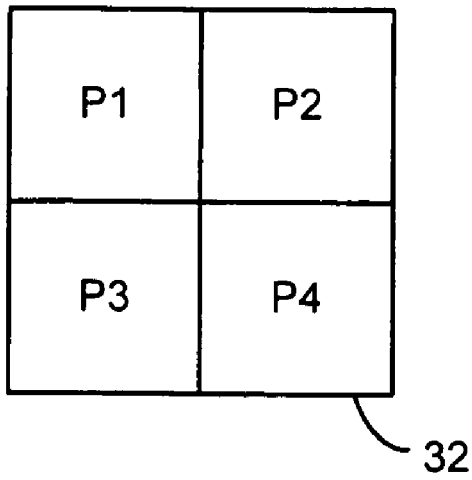
FIG. 7 is an enlarged view of one of the groups of pixels in the display of FIG. 5 or 6.

With reference now to FIG. 5, an exemplary embodiment is described in the context of a display 30 of the type shown in FIG. 3 (i.e., the three primary colors can be handled simultaneously) but configured in a reduced power mode. In accordance with this embodiment, display 30 is subdivided into pixel groups (or super-pixels) wherein each group has a predetermined dimension. In the embodiment of FIG. 5, for example, display 30 includes a 1280×1024 pixels display area that is divided into 327,680 pixel groups (R/G/B_SP__1 through R/G/B_SP__327680). The pixel groups are numbered sequentially from left to right along each row and from top to bottom along each column. As best shown in FIG. 7, each super-pixel 32 in this embodiment comprises four individual pixels (P1 through P4) arranged in a 2×2 rectangle.

With the pixel groups arranged as in FIG. 5, a weighting function may be utilized to significantly increase the number of colors available for each frame. For example, the weighting function may be used to determine an average (e.g., mean, median or mode) color or intensity level of the input image corresponding to the pixels in each group (R/G/B_SP__1 through R/G/B_SP__327680). The weighting function may also take into account the input image for pixels in one or more adjacent groups. In either case, the representative value (e.g., average) of the pixels in the group may be converted into a second set of pixels (e.g., a halftoned image) for display in the super-pixel. For example, if the image corresponding to super-pixel R/G/B_SP__1 in FIG. 5 has an average color level comprising 50% red, this color level could be provided using super-pixel 32 in FIG. 7 by displaying red in two of the four pixels. According to an exemplary embodiment, a mapping technique may be utilized to distribute each primary color across super-pixel 32. For example, a 50% red color level could be provided in super-pixel 32 by displaying red in pixels P1 and P4. Alternatively, red could be displayed in pixels P2 and P3 of super-pixel 32 to provide an equivalent distribution.

Using the foregoing halftoning technique, there are five possible color (or intensity) levels for each primary red, green and blue in super-pixel 32 (see FIG. 7). Table 2 below shows one way to provide these five possible color levels for each primary in super-pixel 32:

| # | R/G/B-P1 | R/G/B-P2 | R/G/B-P3 | R/G/B-P4 |
|---|---|---|---|---|
| 1 | off | off | off | off |
| 2 | ON | off | off | off |
| 3 | ON | off | off | ON |
| 4 | ON | ON | off | ON |
| 5 | ON | ON | ON | ON |

In the embodiment of FIG. 5, the foregoing super-pixel/halftoning technique provides a total of 125 ($=5^3$) colors for each pixel grouping. Although this is much less than the 16.7 million colors available during the true color (i.e., full resolution 24-bit color) operation mode described above in connection with FIG. 3, it is significantly better than the eight colors available without halftoning and still obtains the 256× reduction in power consumption compared to full color mode. Moreover, the penalty resulting from halftoning in this example is only a 2× reduction in resolution.

Figure 6:
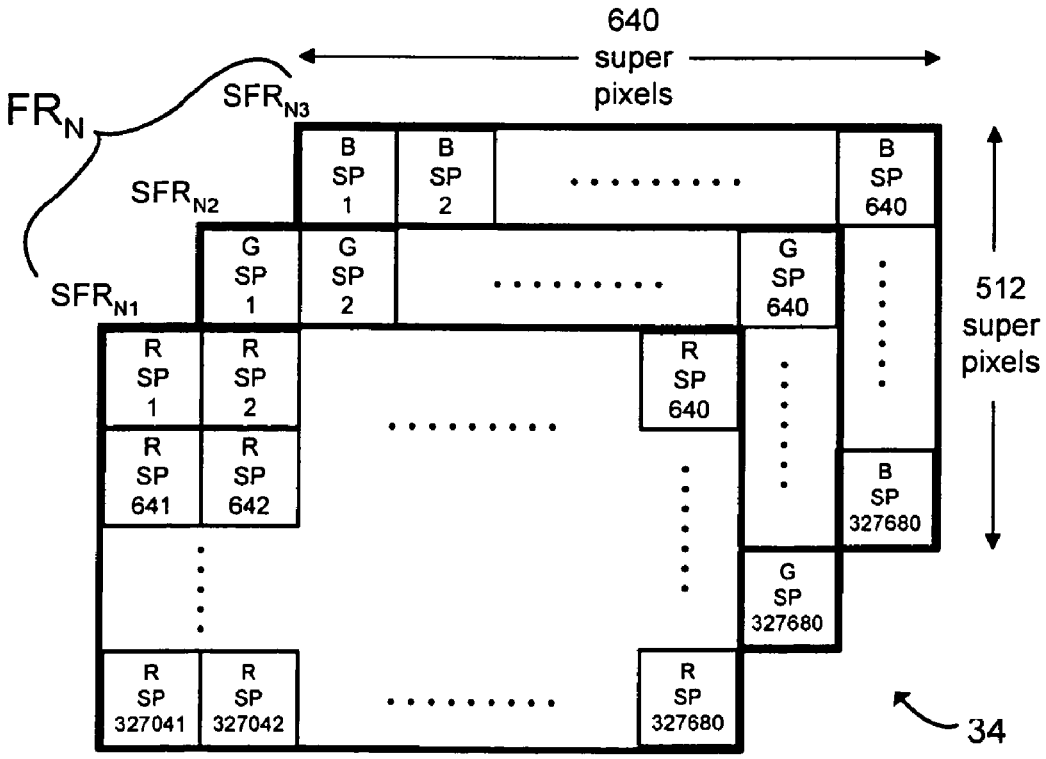
FIG. 6 shows an example of the subdivision of the display of FIG. 4 into groups of pixels in accordance with another embodiment of the present invention.

With reference now to FIG. 6, another exemplary embodiment of the present invention will be described in the context of a display 34 of the type shown in FIG. 4 (i.e., the three primary colors are handled sequentially in three subframes) but configured in a reduced power mode with enhanced color resolution. In this, embodiment, the 1280×1024 pixels display area is again divided into 327,680 pixel groups (R/G/B_SP__1 through R/G/B_SP__327680). Hence, each pixel group comprises a 2×2 super-pixel 32 as shown in FIG. 7. As explained above with the embodiment of FIG. 5, this arrangement provides five color (or intensity) levels for each primary, which provides 125 ($=5^3$) total colors per super-pixel per frame using the halftoning technique described above. The power consumption mode in this embodiment is still reduced by a factor of 256 compared to true color operation mode.

Figure 8:
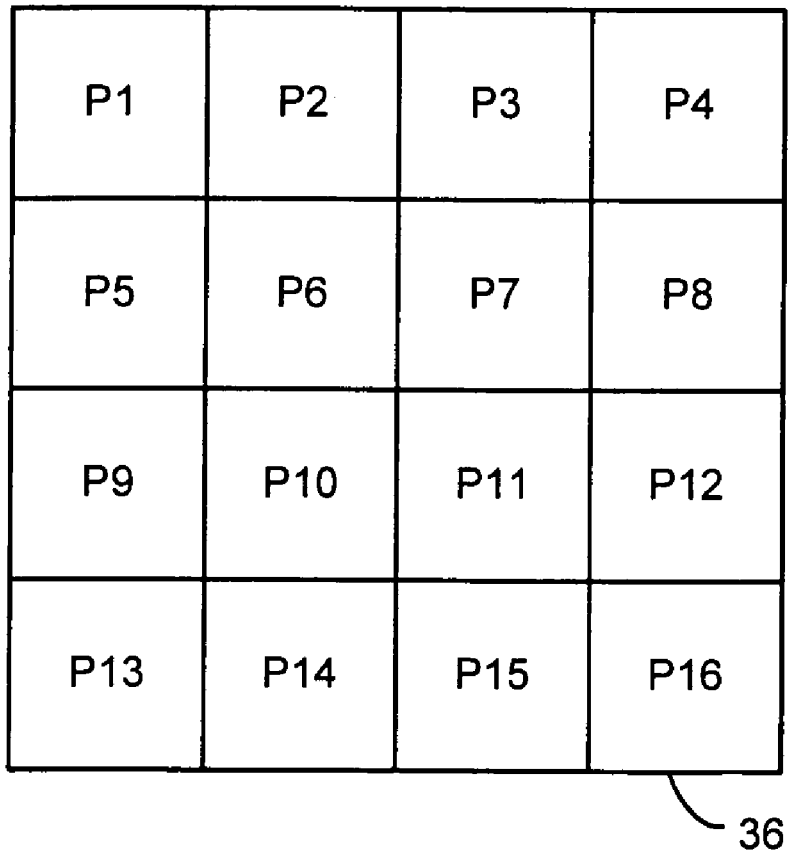
FIG. 8 is a view of an example of a group of pixels in accordance with another embodiment of the present invention.

Referring now to FIG. 8, an alternative embodiment of a super-pixel 36 is shown for configuring a display to provide the same reduced power consumption as in the embodiments of FIGS. 5 and 6 but with more colors. In this embodiment, each super-pixel 36 comprises a 4×4 grouping of pixels (P1 through P16). With this arrangement, there are 17 possible color (or intensity) levels for each primary because anywhere between zero and sixteen pixels in super-pixel 36 may display each primary color (either simultaneously with the device of FIG. 3 or sequentially with the device of FIG. 4) during each frame. This arrangement provides a total of 4,913 ($=17^3$) possible colors for each super-pixel 36 during each frame, while still providing the 256× power reduction. Although this operating mode has a 4× reduction in resolution compared to true color mode, this level of resolution may be easily tolerated in many situations such as on displays that are already very high resolution and/or when viewing graphics (i.e., non-natural images).

The above-described super-pixel/halftoning technique could easily be extended for even larger super-pixel sizes to provide more colors. For example, a display of the type shown in FIG. 3 (i.e., all three primaries handled simultaneously) could be divided into super-pixels having dimensions of 5×5 pixels (i.e., 25 pixels per group) to provide for 17,576 ($=26^3$) total colors per frame without using any subframes. Similarly, the same color depth (i.e., 17,576 total colors) could be obtained in a display of the type shown in FIG. 4 (i.e., the three primaries handled sequentially) using 5×5 super-pixels and three subframes per frame (i.e., one subframe per primary). Both of these example embodiments would provide the 256× reduction in power compared to true color mode.

Figure 9:
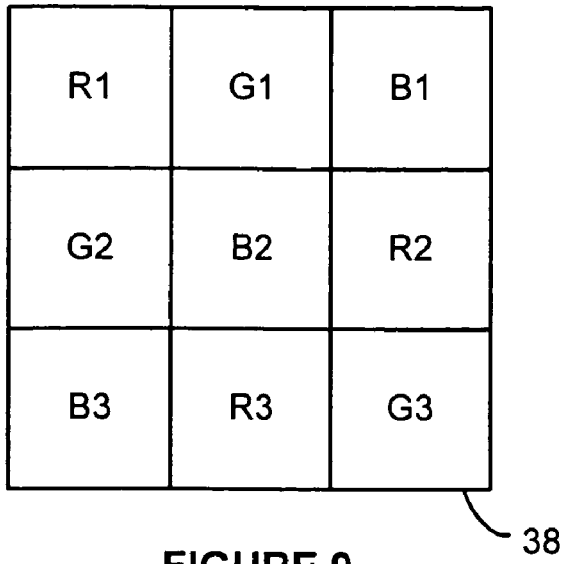
FIG. 9 is a view of an example of another group of pixels in accordance with still another embodiment of the present invention.

Referring now to FIG. 9, an alternative arrangement is illustrated for displaying primaries in a super-pixel 38. In this arrangement, a color mapping may be used to determine which pixels in super-pixel 38 display which primaries. This embodiment might be useful in capacitively driven display devices that are capable of displaying all three primaries simultaneously, but each pixel can only display one primary at a time. Assuming no subframes, this arrangement would allow for four possible color levels per primary per frame, yielding 64 ($=4^3$) total colors per frame, with power consumption still cut by a factor of 256.

Figure 10:
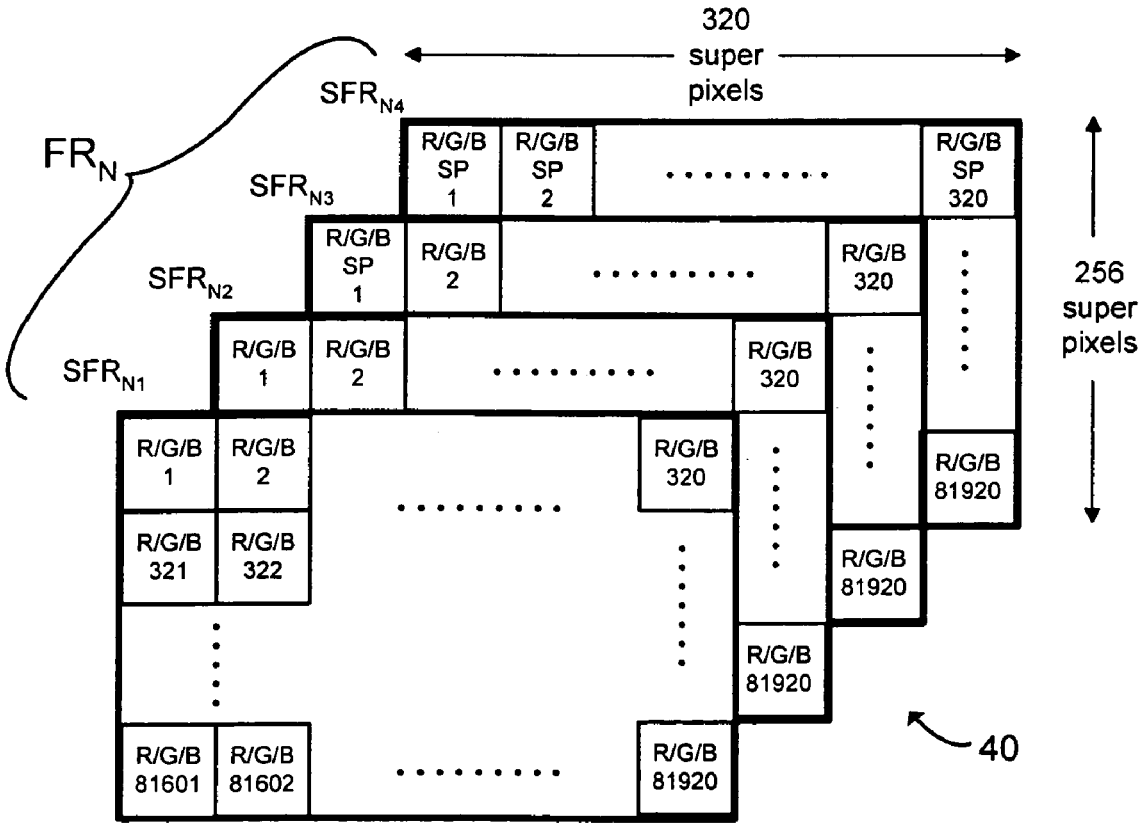
FIG. 10 shows an example of a relationship between the frame frequency and the subframe frequency for driving the display device of FIG. 3 in accordance with another embodiment of the present invention.

Turning now to FIG. 10, an example of a hybrid embodiment is shown in which a display 40 of the type shown in FIGS. 3 and 5 (i.e., all three primaries are handled simultaneously) is configured to provide significantly more colors than in the embodiment of FIG. 5. In this embodiment, the pixels in display 40 are grouped into 4×4 super-pixels (as shown in FIG. 8) that are switched four times per frame (i.e., four subframes per frame), rather than once per frame as in the embodiment of FIG. 5. This arrangement allows 17 color levels per primary per subframe, which provides 68 (=17×4) color levels per primary for the frame. Hence, there are a total of 314,432 ($=68^3$) total colors available per frame in this embodiment, while still saving 64 times the power used in true color mode.

In accordance with an exemplary embodiment, a mode select switch may be provided to allow a user to select between a high image quality (e.g., true color 24-bit) mode of operation and one or more reduced power consumption modes of operation. In this embodiment, the mode select switch may allow the user to select one of the reduced power consumption modes using various criteria such as indicating a desired number of colors or dimension size for the pixel groupings. Alternatively, one or more power consumption modes may be suggested to the user automatically by controller 16 or microprocessor 20 based on criteria such as the amount of battery power remaining and/or the type of image(s) to be displayed.

One consideration when implementing the present invention according to the above-described or other embodiments is pixel leakage. Any display technology employed for the capacitive element of the display should be able to hold a charge for the length of time between recharges. In the worst case described above (i.e., switching only once per frame), the necessary hold time would be 16.6 mS for a 60 Hz frame rate. For most LCDs and micro-mirror display devices, pixel leakage would not be a problem for this length of time. Other types of display devices may require higher switching rates if pixel leakage is exhibited.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A multi-mode display device including a display comprising an array of pixels, comprising:

means for driving the display in a first display mode that provides high image quality; and means for driving the display in a second display mode that provides reduced power consumption and lower screen resolution, wherein the means for driving the display in the second display mode comprises:

means for dividing the array of pixels into groups of pixels;

means for receiving image data for one of the pixel groups;

means for calculating a representative value of the image data; and means for driving the one group of pixels to display the representative value of the image data.

2. The device of claim 1, wherein the representative value is an average of the image data and the calculating means converts the average of the image data into a halftoned set of pixel colors.

3. The device of claim 1, wherein the calculating means calculates an average intensity level for each primary color in the image data.

4. The device of claim 3, further including means for converting the average intensity level for each primary color into a separate halftoned set of pixels.

5. The device of claim 1, wherein the one group of pixels is a rectangular array.

6. The device of claim 1, wherein the display is capacitively driven.

7. The device of claim 6, wherein the display is selected from a liquid-crystal display device, a digital micro-mirror display device, and an interferometric display device.

8. The device of claim 1, further including means for switching between the first and second display modes.

9. The device of claim 1, wherein the means for driving the display in the second display mode switches the array of pixels only once per frame.

10. The device of claim 1, wherein the means for driving the display in the second display mode switches the array of pixels only once for each primary color per frame.

11. A multi-mode display device, comprising:

a display including a pixel display area;

a controller configured to drive the display in accordance with first and second display modes, the first display mode providing high image quality and the second display mode providing reduced power consumption at lower image quality;

a memory containing image data, and wherein the controller operating in the second display mode is configured to:

receive image data for one group of pixels from the memory;

calculate a representative value of the image data; and driving the one group of pixels to display the representative value of the image data.

12. The device of claim 11, wherein the representative value is an average of the image data and the controller operating in the second display mode is configured to convert the average into a halftoned set of pixel colors for each primary color.

13. The device of claim 11, wherein the display is capacitively driven,.

14. The device of claim 11, further including a switch configured to placing the controller in the first display mode and the second display mode.

15. The device of claim 14, wherein the switch is user selectable.

16. The device of claim 11, wherein the controller is configured to suggest a display mode to a user based on at least one of battery power remaining and a type of image data to be displayed.

* * * * *

UNITED STATES PATENT AND TRADEMARK OFFICE

CERTIFICATE OF CORRECTION

PATENT NO. : 7,439,965 B2
APPLICATION NO. : 10/794621
DATED : October 21, 2008
INVENTOR(S) : Daryl E. Anderson It is certified that error appears in the above-identified patent and that said Letters Patent is hereby corrected as shown below:

In column 8, line 12, in Claim 13, after “driven” delete “,”.

Signed and Sealed this

Twenty-first Day of July, 2009

JOHN DOLL
*Acting Director of the United States Patent and Trademark Office*